US007337512B2

(12) United States Patent
Münstermann et al.

(10) Patent No.: US 7,337,512 B2
(45) Date of Patent: Mar. 4, 2008

(54) HYDRODYNAMIC NEEDLING APPARATUS

(75) Inventors: Ullrich Münstermann, Egelsbach (DE); Roland Sperlich, Schwalbach (DE)

(73) Assignee: Fleissner GmbH, Egelsbach (DE)

( * ) Notice: Subject to any disclaimer, the term of this patent is extended or adjusted under 35 U.S.C. 154(b) by 254 days.

(21) Appl. No.: 11/142,002

(22) Filed: Jun. 1, 2005

(65) Prior Publication Data

US 2006/0021205 A1 Feb. 2, 2006

(30) Foreign Application Priority Data

Jul. 29, 2004 (DE) ..... 10 2004 036 906

(51) Int. Cl.
*D06B 1/02* (2006.01)
*D04H 1/46* (2006.01)

(52) U.S. Cl. ..... 28/104; 28/167

(58) Field of Classification Search ..... 28/104, 28/105, 167, 106; 68/200, 205 R, 201; 239/548, 239/554, 556, 557, 560
See application file for complete search history.

(56) References Cited

U.S. PATENT DOCUMENTS 3,214,819 A 11/1965 Guerin
3,493,462 A * 2/1970 Bunting, Jr. et al. ..... 442/405
3,873,255 A 3/1975 Kalwaites ..... 425/83
4,960,630 A 10/1990 Greenway ..... 428/131
5,281,441 A 1/1994 Kasai ..... 427/300
5,737,813 A * 4/1998 Sternlieb et al. ..... 28/167
5,806,155 A 9/1998 Malaney ..... 281/167
6,253,429 B1 * 7/2001 Zolin ..... 28/104
6,571,441 B1 * 6/2003 Kobayashi et al. ..... 28/104
6,877,196 B2 4/2005 Oathout ..... 28/104
2001/0018786 A1 * 9/2001 Greenway et al. ..... 28/104
2002/0116801 A1 * 8/2002 Oathout et al. ..... 28/104
2003/0101558 A1 * 6/2003 Sternlieb et al. ..... 28/167
2004/0078945 A1 * 4/2004 Fleissner ..... 28/104

* cited by examiner

*Primary Examiner*—Amy B. Vanatta
(74) *Attorney, Agent, or Firm*—Andrew Wilford

(57) ABSTRACT

A hydrodynamic needling apparatus for use on a textile web moving in a longitudinal web-travel direction has a first array of needle-jet orifices emitting respective needle-jet sprays extending in the travel direction between the respective orifices and the web, the array extending transversely across a full transverse width of the web at a substantially constant spacing therefrom with the sprays forming an angle greater than 0° and less than 90° with the web-travel direction. There is a similar second array of needle-jet orifices, but with it the orifices are directed at the same angle but oppositely to the sprays of the first array. Thus the sprays of the first array are directed to one side and the sprays of the second array to an opposite side from the respective arrays.

11 Claims, 1 Drawing Sheet

HYDRODYNAMIC NEEDLING APPARATUS

FIELD OF THE INVENTION

The invention relates to a device for the hydrodynamic treatment of a woven fabric, or also a knitted fabric, of a certain width, with a jet bar and a jet strip arranged in it with a multitude of orifices arranged closely adjacent to each other for the formation of a water curtain directing hard water jets at the filaments and their crossing points of the fabric, or such.

BACKGROUND OF THE INVENTION

A method usable for this device, and a product achieved thereby is known for U.S. Pat. No. 5,281,441. Depending on the yarn used, the individual fibers are not distributed parallel to one another by means of the water needling, but are adhered on top of one another, and do not result in the previously known pattern according to FIGS. 1, 3 of this patent.

It is known to direct the water jets in the web-travel direction at an angle against the product web; in this regard, reference is made to U.S. Pat. Nos. 3,214,819, 3,873,255, 5,737,813, 5,806,155, or 6,253,429. However, this does not enable the water jets to have an influence on the warp and weft of a fabric. The sample applies to the solution according to U.S. Pat. No. 4,960,630, according to which the water jets are like a fan. In this configuration, the water jets adjacent to each other interfere with one another.

Another solution of the lateral effect on the fibers has become known in an application on the hydrodynamic treatment of a non-woven fiber material as describes in U.S. Pat. No. 6,877,196. The evening out of the thickness of the non-woven material is performed by angled impacting water jets that are projected from a water bar that is normally arranged parallel to the product web, however, the jet strips are equipped with orifices extending at an angle to the product web. According to FIG. 5 of this patent, the orifices may also be directed in the opposite direction from the water bar from right to left, which has the advantage that the product web does not laterally shift on the endless belt carrying it, due to a unilateral impulse. If applied to a fabric, this would result in the treatment of the warp filaments. An even distribution of all fibers of a fabric, however, would still not be achieved.

OBJECT OF THE INVENTION

Starting from the device of the type descried above, the invention is based on the task of finding a device, with which all filaments of a fabric may be treated across their entire length and distribution with water jets, while spreading the fibers apart.

SUMMARY OF THE INVENTION

In order to solve this task, the invention provides that for the shifting, spreading, evening out, and, if necessary, also for splitting the fibers of all yarns, the jet bar is aligned at an even distance across its length, but at an angle to the longitudinal direction of the product web, and across its entire effective width, and that additionally all the jet orifices of the jet strip are directed not perpendicularly, but at an angle, and therefore the water jets are also angled to the product web. In this case it is also advantageous if the discharging water jets of jet bars, or jet strips that are arranged behind one another, are directed against one another in order to avoid any shifting of the product web on the endless belt carrying it.

BRIEF DESCRIPTION OF THE DRAWING

A device of the type according to the invention is illustrated by way of an example in the drawings. They show.

SPECIFIC DESCRIPTION

Figure 1:
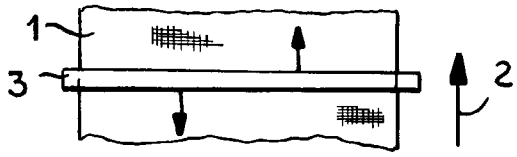
PRIOR ART FIG.1
FIG. 1 a schematic top view of a simple product web woven with warp and weft, with a jet bar in accordance with the prior art, FIG. 2 a product web with water jet treatment according to the invention, FIGS. 3*a* and 3*b* a product web with jet bars extending transversely but across the effective width of the web and having different angles to the web-travel direction.
Figure 2:
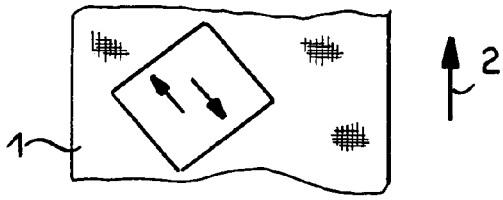

As shown in FIG. 1, a product web 1 according to U.S. Pat. No. 5,281,441, woven with warp and weft, moves in the direction of arrow 2 by means of a forward running endless belt that carries the same, and is subjected to perpendicularly impinging, hard water jets from a jet bar 3 extending transversely across the full width of the product web 1. This is prior art. It is also known to incline the jets into the web-travel direction of the product web, or against the web-travel direction. However, this does not result in an even treatment of all warp and weft filaments within the fabric 1. The treatment according to FIG. 2, with a web 1 moving in the direction of arrow 2 is the desired treatment.

Figure 3A:
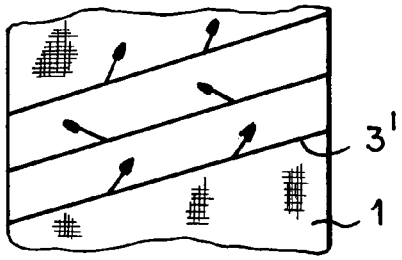
Figure 3B:
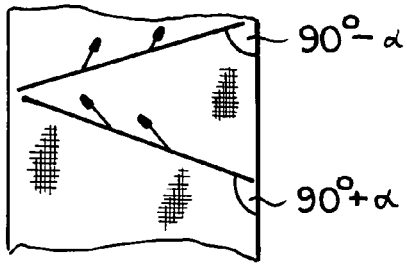

In order to achieve this mechanically, according to FIGS. 3 and 5, the jet bars 3' are aligned transversely across the longitudinal direction 2 of the product web 1, and across its entire effective width, and additionally all the jet orifices of the jet strip are directed not perpendicularly or parallel to the direction 2, but at an angle thereto, and therefore the water jets are effective at this angle against the product web. The jet bars 3' can extend parallel to each other as shown in FIG. 3*a*, or each alternating at an angle of 90°+a, or 90°−a, according to FIG. 3*b*, across the product web 1.

It is also advantageous if laterally aligned, and laterally spraying jet bars are combined with jet bars whose jet strips have orifices aligned perpendicularly on the product web. In this regard, an embodiment of jet bars and assigned jet strips would be meaningful having jet orifices in the center spraying laterally in both directions, and a jet bar is arranged in front and behind, with jet strips that are aligned as usual in the prior art perpendicularly onto the product web 2.

Figure 4A:
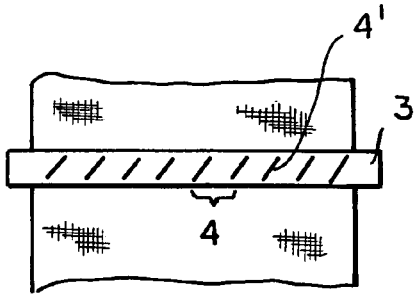
FIGS. 4*a* and 4*b* a product web with jet bars extending transversely to web-travel direction, but with jet strips supported in it with jet orifices extending at angles in segments.
Figure 4B:
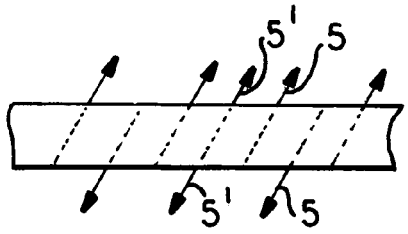

According to FIG. 4*a* it is also possible to embody the jet bar 3 perpendicular or at a slight angle across the product web, but to equip the jet strip with jet orifices not directed parallel to the web-travel direction 2, but at an angle thereto, and adjacent to one another in segments 4' at short distances 4 from each other. The jet orifices are each directed obliquely and are inclined in opposite directions, as is indicated in FIG. 4*b* by the arrow 5. However, it is also possible in the case of the segments 4 to provide jet orifices 5' in each segment that spray in the manner of a fan, which thus spray perpendicularly, as well as in both directions laterally to the product web.

Figure 5A:
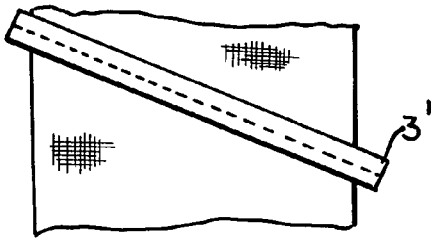
FIGS. 5*a*, 5*b*, and 5*c* a product web with jet bars extending transversely, in the jet strips of which two jet orifice rows are integrated with the orifices being inclined in opposite directions, or two jet bars with only one jet orifice row each, which are then each inclined in opposite directions.
Figure 5B:
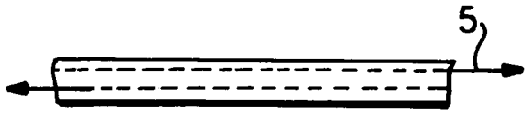
Figure 5C:
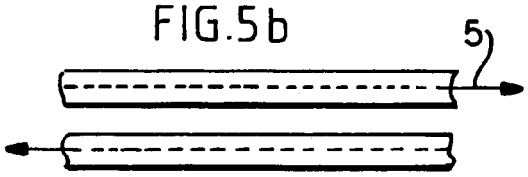

In a jet bar according to FIG. 5*a* that extends laterally across the width of the product web, the one jet strip, FIG. 5*b*, may have two rows of jet orifices that are aimed obliquely in opposite directions 5, or at least two jet bars according to FIG. 5*c* may be provided adjacent to each other with one jet strip each. Here the orifices have jet orifices that are inclined in opposite directions 5.

The invention claimed is:

1. A hydrodynamic needling apparatus for use on a textile web moving in a longitudinal web-travel direction, the apparatus comprising a first array of needle-jet orifices emitting respective needle-jet sprays extending in the travel direction between the respective orifices and the web, the array extending transversely across a full transverse width of the web at a substantially constant spacing therefrom with the sprays forming an angle greater than 0° and less than 90° with the web-travel direction; and a second array of needle-jet orifices emitting respective needle-jet sprays extending in the travel direction between the respective orifices and the web, the second array extending transversely across a full transverse width of the web at a substantially constant spacing therefrom with the respective sprays forming the same angle with the web-travel direction as the sprays of the first array, but oppositely thereto, whereby the sprays of the first array are directed to one side and the sprays of the second array to an opposite side from the respective arrays.

2. The apparatus according to claim 1 wherein the web is substantially horizontal and the jets are directed at 5 to 30 degrees to a vertical line substantially perpendicular to the web.

3. The apparatus according to claim 2, further comprising a jet strip having both arrays of jet orifices, the jet orifices of one of the arrays being aligned oppositely but at the same angle to the web-travel direction as the other of the two arrays.

4. The apparatus according to claim 2, further comprising a jet bar with jet orifices directed perpendicularly to the web.

5. The apparatus according to claim 1, further comprising a jet strip is perpendicular to the web-travel direction and having both arrays of orifices, the orifices of the jet strip being directed not parallel to the jet strip but at an angle thereto.

6. The apparatus according to claim 5 wherein orifices of the jet strip are directed oppositely to one another but at the same angle to the web-travel direction.

7. The apparatus according to claim 5 wherein the orifices are arrayed like a fan in the jet strip.

8. The apparatus according to claim 1 wherein the angle is between 10° and 80°.

9. The apparatus defined in claim 1, further comprising a third such needle-jet strip whose orifices emit jets lying in planes parallel to the web-travel direction.

10. The apparatus defined in claim 1 wherein the jets each lie in a respective vertical plane extending at the angle to the web-travel direction.

11. The apparatus defined in claim 1 wherein each of the sprays extends in a plane forming the angle with the web-travel direction and nonperpendicular and nonparallel to the web-travel direction.

* * * * *